US008157358B2

(12) United States Patent
Tamaru et al.

(10) Patent No.: US 8,157,358 B2
(45) Date of Patent: Apr. 17, 2012

(54) LIQUID EJECTION HEAD SUBSTRATE AND LIQUID EJECTION HEAD

(75) Inventors: Yuuji Tamaru, Yokohama (JP); Yoshiyuki Imanaka, Kawasaki (JP); Koichi Omata, Kawasaki (JP); Hideo Tamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

(21) Appl. No.: 12/636,140

(22) Filed: Dec. 11, 2009

(65) Prior Publication Data

US 2010/0149281 A1 Jun. 17, 2010

(30) Foreign Application Priority Data

Dec. 17, 2008 (JP) ..... 2008-321646

(51) Int. Cl.
*B41J 2/05* (2006.01)

(52) U.S. Cl. ..... 347/63

(58) Field of Classification Search ..... 347/11, 347/12, 40, 50, 63
See application file for complete search history.

(56) References Cited

U.S. PATENT DOCUMENTS 6,499,823 B2 * 12/2002 Okazaki et al. ..... 347/20
2009/0309930 A1 * 12/2009 Tamura et al. ..... 347/50

FOREIGN PATENT DOCUMENTS

JP 3-005151 1/1991

* cited by examiner

*Primary Examiner* — An Do
(74) *Attorney, Agent, or Firm* — Canon USA Inc IP Division

(57) ABSTRACT

A liquid ejection head substrate includes a primary conductive layer; an insulating layer; a pair of secondary conductive layers; a first connecting portion where the primary conductive layer is electrically connected to the secondary conductive layers, the first connecting portion penetrating the insulating layer; and a second connecting portion whose contact area is smaller than that of the first connecting portion. In the secondary conductive layers, a voltage is applied such that a first secondary conductive layer has a higher potential than a second secondary conductive layer.

13 Claims, 12 Drawing Sheets

LIQUID EJECTION HEAD SUBSTRATE AND LIQUID EJECTION HEAD

BACKGROUND OF THE INVENTION

1. Field of the Invention

The present invention relates to a liquid ejection head substrate and a liquid ejection head. Specifically, the present invention relates to an ink jet head substrate and an ink jet head including a foaming heater that allows ink to be foamed and a sub-heater that preheats a substrate.

2. Description of the Related Art

In typical thermal liquid ejection heads (hereinafter also referred to as heads), a liquid ejection heater (hereinafter also referred to as a heater) that generates energy for ejecting liquid and a conductive layer that supplies electricity to the heater are disposed on a substrate. A channel member that defines a channel communicating with an ejection port configured to eject liquid is disposed on the substrate.

In recent years, some thoughts have been put into a liquid ejection head substrate (hereinafter also referred to as a head substrate) to stabilize liquid ejection. For example, there is a technology in which a substrate-heating heater (hereinafter also referred to as a sub-heater) that preheats a substrate is independently disposed in addition to an ejection heater.

Japanese Patent Laid-Open No. 3-005151 discloses that the degradation of ejection characteristics caused at a low temperature is prevented by forming a heater and a sub-heater both composed of the same material in the same layer and by heating a head substrate using the sub-heater.

The reliability of a sub-heater will be described. When a conductive layer (hereinafter also referred to as a wiring sub-heater) is used as a sub-heater by supplying a high current to aluminum (Al) commonly used as a conductive layer, attention needs to be paid to electromigration durability.

Electromigration (hereinafter also referred to as E. M.) is a phenomenon in which, by supplying an electric current to a conductive layer, aluminum (Al) atoms constituting the conductive layer move in a direction in which electrons flow. As a result, voids (holes), hillocks (bumps), and whiskers (whisker-shaped growth) are produced. It is widely known that mean time to failure due to E. M. is expressed using Black's empirical formula. According to Black's empirical formula, the mean time to failure due to E. M. is normally inversely proportional to the nth power of current density (normally n is 2, which depends on a temperature gradient, accelerating conditions, or the like). In other words, when a wiring sub-heater is used, current density needs to be reduced to a certain value or less to achieve a sufficiently long life against E. M.

Reference: Black's empirical formula $$MTTF = A \times J^{-n} \times e^{Ea/kT}$$

MTTF: mean time to failure (hour)

A: a constant determined in accordance with a structure and a material of a conductive layer J: current density ($A/cm^2$)

n: a constant representing current density dependence

Ea: activation energy (eV) (normally 0.4 to 0.7 eV, which depends on orientation, a particle size, a protective layer, or the like)

k: Boltzmann's constant $8.616 \times 10^{-5}$ eV/K

T: absolute temperature of a conductive layer (K)

To use a wiring line composed of a conductive layer as a sub-heater, power consumption that exceeds a certain value is needed. To secure the required power consumption and to achieve a long life against E. M., current density needs to be reduced while a constant resistance is maintained. Consequently, the wiring line needs to be lengthened and the sectional area needs to be increased. For example, when the length of the wiring line is doubled and the sectional area is doubled, the power consumption does not change because the resistance of the wiring line constituting the wiring sub-heater does not change. On the other hand, since the current density can be reduced by one half, the mean time to failure can be lengthened to a value that is about four times the original value according to Black's empirical formula.

As described above, in the wiring sub-heater, the wiring line needs to have an appropriate length and sectional area to achieve a long life against E. M. Furthermore, to preheat a substrate in a uniform temperature distribution, the wiring line constituting the sub-heater should be uniformly arranged on a head substrate when viewed in plan.

To secure the wiring line having an appropriate length and dispose the wiring sub-heater on a head substrate in a substantially uniform manner, it is effective to constitute the wiring sub-heater using a plurality of conductive layers.

In view of the foregoing, the inventors of the present invention performed E. M. durability investigation, which posed a problem in that the E. M. durability at a connecting portion (111) of an insulating layer that is a contact portion of conductive layers is poorer than that in a region of a conductive portion (112).

According to Black's empirical formula, an area of the connecting portion can be increased to improve the E. M. durability at the connecting portion as described above. However, an unnecessarily large connecting portion increases a substrate size.

SUMMARY OF THE INVENTION

The present invention provides a liquid ejection head having good durability without increasing a substrate size.

A liquid ejection head substrate of the present invention includes a substrate on which a primary conductive layer, an insulating layer, and first and second secondary conductive layers are stacked in sequence in that order; a first connecting portion where the primary conductive layer contacts the first secondary conductive layer, the first connecting portion penetrating the insulating layer; and a second connecting portion where the primary conductive layer contacts the second secondary conductive layer, the second connecting portion penetrating the insulating layer. In the liquid ejection head substrate, a contact area where the primary conductive layer contacts the second secondary conductive layer in the second connecting portion is smaller than a contact area where the primary conductive layer contacts the first secondary conductive layer in the first connecting portion. Furthermore, when a voltage is applied, the first secondary conductive layer has a higher potential than the second secondary conductive layer.

According to the present invention, there can be provided a liquid ejection head having good durability without increasing a substrate size.

Further features of the present invention will become apparent from the following description of exemplary embodiments with reference to the attached drawings.

DESCRIPTION OF THE EMBODIMENTS

Figure 8:
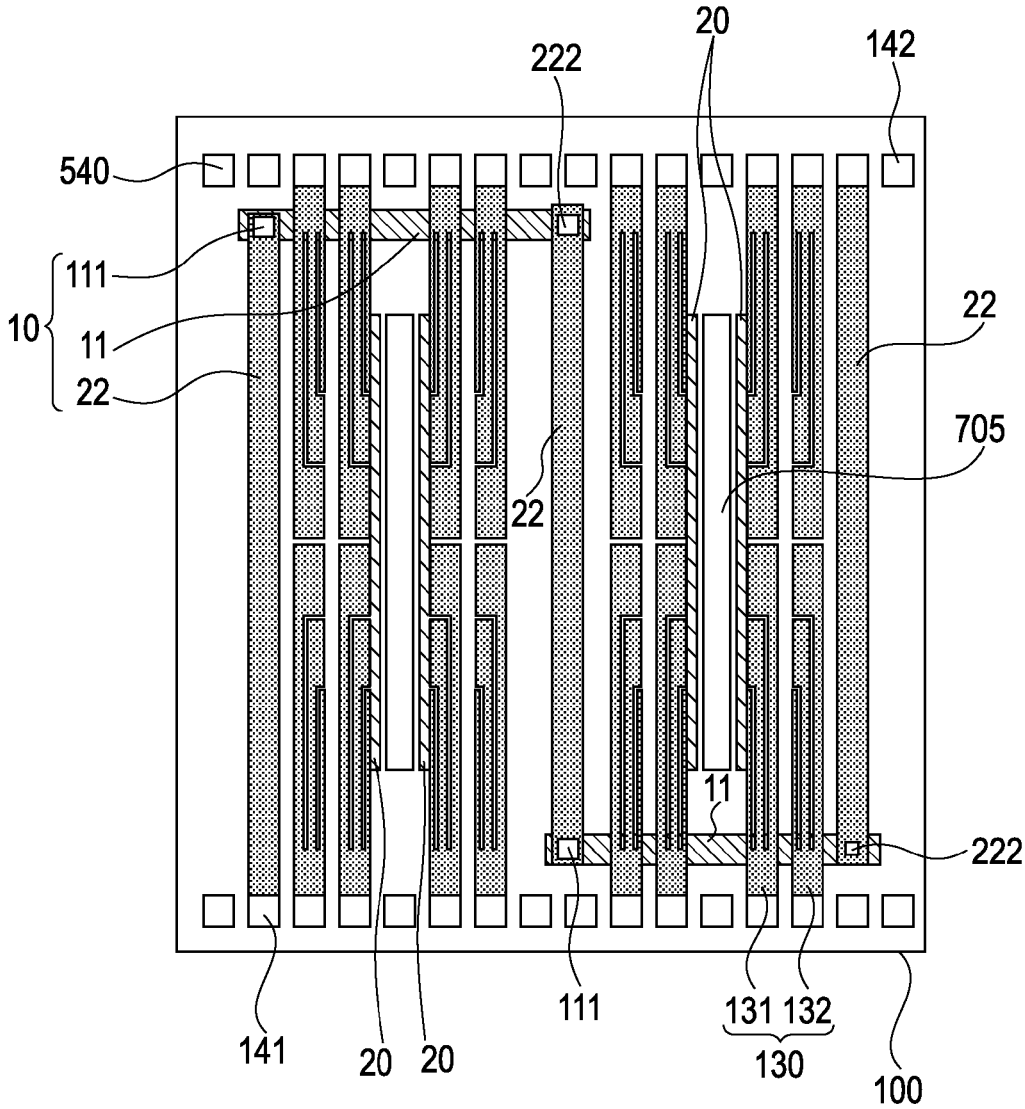
FIG. 8 is a schematic plan view of a head substrate of Comparative Example.

FIG. 8 is a schematic view of a liquid ejection head substrate that uses a wiring sub-heater. The liquid ejection head substrate includes an ejection heater and a wiring sub-heater. The liquid ejection head substrate is obtained by stacking, in sequence, a primary conductive layer 11, an insulating layer, a metal layer that prevents metal diffusion and is used as a conductive layer or the like, and at least one secondary conductive layer 22 on a substrate composed of silicon or the like. The primary conductive layer is in contact with the secondary conductive layers at a first connecting portion 111 and a second connecting portion 222 through the insulating layer. The wiring sub-heater is constituted by the primary conductive layer and the secondary conductive layer, and is disposed on a substrate so as to extend between supply ports 705 and extend as if drawn with a single stroke.

Using the wiring sub-heater shown in FIG. 8, the inventors of the present invention performed E. M. durability investigation, which posed a problem in that E. M. durability at the connecting portion (111) of the insulating layer that is a contact portion of the conductive layers is poorer than that at a conductive portion (112). Furthermore, they compared the E. M. durability of the first connecting portion in which electrons flow from the primary conductive layer to the secondary conductive layer through the metal layer with the E. M. durability of the second connecting portion in which electrons flow from the secondary conductive layer to the primary conductive layer through the metal layer. This comparison clarified, for the first time, a problem in that E. M. durability of the first connecting portion is poorer than that of the second connecting portion.

Figure 9A:
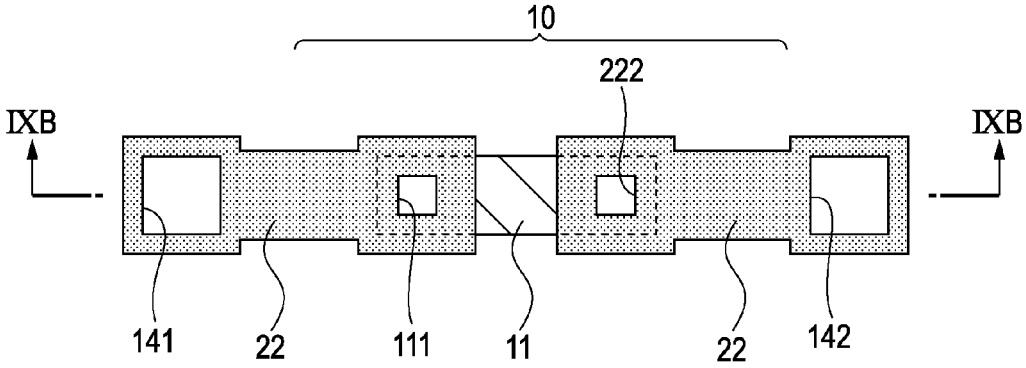
FIGS. 9A and 9B are respectively a schematic plan view and a schematic sectional view of a sub-heater of Comparative Example.

Hereinafter, the specific investigation about this phenomenon will be described with reference to FIGS. 8 to 10C. FIG. 9A is a plan view schematically showing the wiring sub-heater 10 of FIG. 8. The wiring sub-heater 10 is constituted by the primary conductive layer 11 and the secondary conductive layers 22, and the primary conductive layer 11 is electrically connected to the secondary conductive layers 22 at the first connecting portion 111 and at the second connecting portion 222. The wiring sub-heater 10 is electrically connected to an external control device through a sub-heater power source pad 141 and a sub-heater ground pad 142.

In the scope of this specification and Claims, the at least one secondary conductive layer 22 is constituted by a pair of secondary conductive layers 22 (first and second). A connecting portion that connects the primary conductive layer to the first secondary conductive layer is defined as a first connecting portion 111. A connecting portion that connects the primary conductive layer to the second secondary conductive layer is defined as a second connecting portion 222.

Figure 9B:
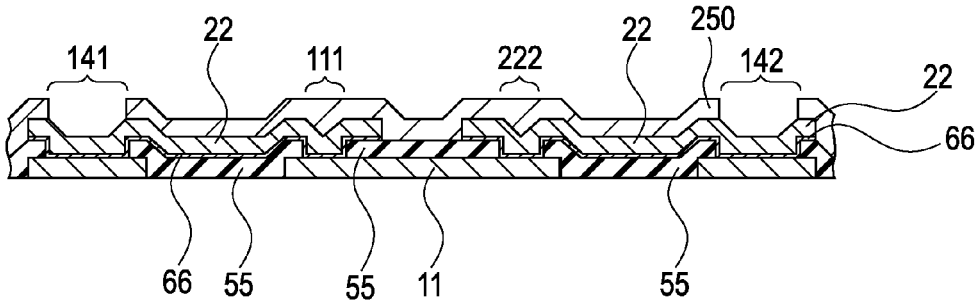

FIG. 9B is a sectional view taken along line IXB-IXB of FIG. 9A. The wiring sub-heater 10 is obtained by stacking the primary conductive layer 11, the insulating layer 55, the metal layer 66, and the secondary conductive layer 22 in sequence from the substrate side. In the wiring sub-heater 10, the primary conductive layer 11 is connected to the secondary conductive layer 22 through the connecting portion 111 that is opened in the insulating layer 55. In addition, a protective layer 250 is stacked on the secondary conductive layer 22. The protective layer 250 prevents liquid from entering the conductive layers. A terminal portion of the protective layer 250 is a conductive pad connected to the outside.

Figure 10A:
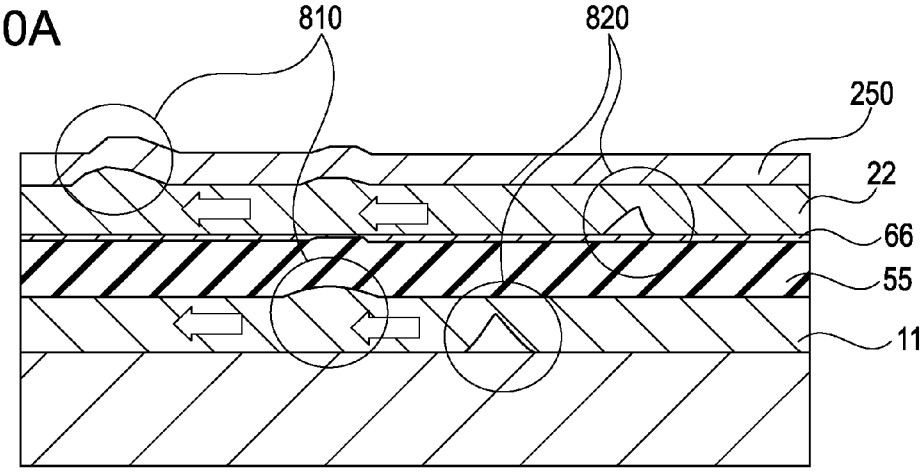
FIGS. 10A to 10C are schematic sectional views of sub-heaters after an E. M. durability test.
Figure 10B:
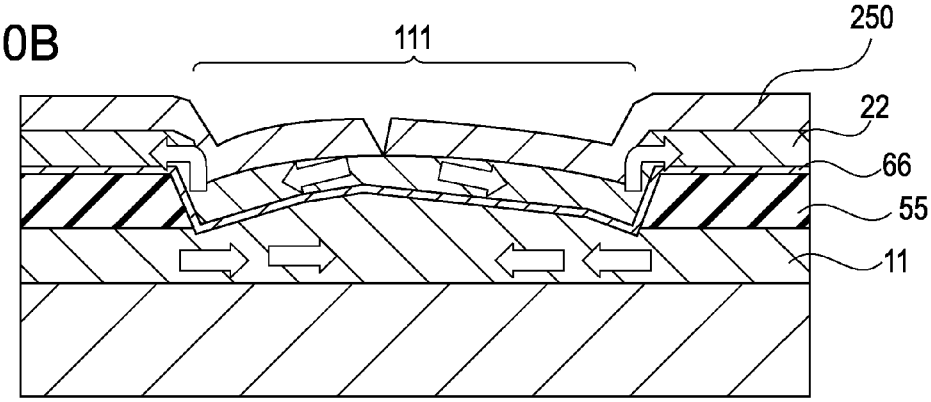
Figure 10C:
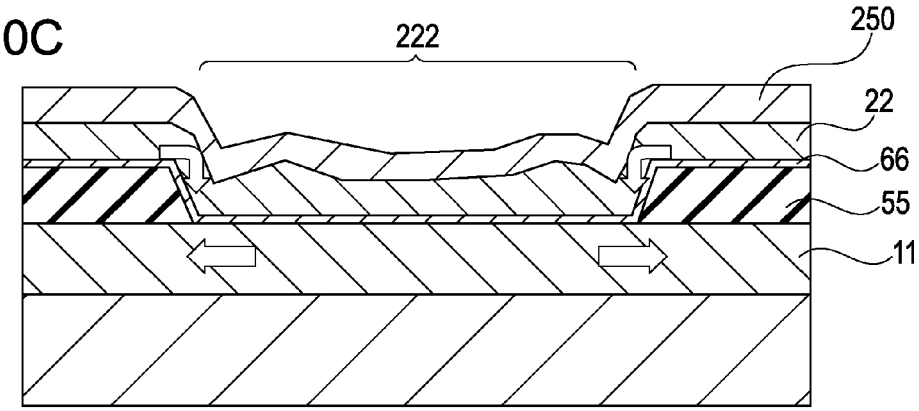

Next, the investigation about E. M. durability will be described. In this investigation, a sample includes the primary conductive layer 11 and the secondary conductive layer 22 composed of aluminum (Al), the metal layer 66 composed of TaSiN, the insulating layer 55 composed of SiO, and the protective layer 250 composed of SiN. FIGS. 10A to 10C are schematic sectional views of the wiring sub-heater used to investigate E. M. durability.

FIG. 10A is a sectional view of a conductive portion (the primary conductive layer 11 and the secondary conductive layer 22). Hillocks (bumps) 810 and voids (holes) 820 are produced to some extent because of the migration of Al atoms.

FIG. 10B is a sectional view of the first connecting portion in which electrons flow from the primary conductive layer to the secondary conductive layer through the metal layer. Al atoms of the primary conductive layer are accumulated at the first connecting portion because of the migration of Al atoms, which remarkably produces hillocks (bumps).

FIG. 10C is a sectional view of the second connecting portion in which electrons flow from the secondary conductive layer to the primary conductive layer through the metal layer. Al atoms of the secondary conductive layer are accumulated at the second connecting portion because of the migration of Al atoms, which produces hillocks (bumps) to some extent.

As described above, it is obvious that the failure at the connecting portions of the insulating layer is more remarkable than that at the conductive portion (the primary conductive layer 11 and the secondary conductive layer 22). In particular, it is clear that the structural failure of the first connecting portion is more remarkable than that of the second connecting portion.

The difference in this phenomenon is explained from the following mechanism.

The E. M. at the conductive portion is typical E. M. caused by the migration of Al atoms due to the collision of the Al atoms with electrons. In this case, electrons move in a single direction.

At the first connecting portion 111 shown in FIG. 10B, electrons in the primary conductive layer 11 flow into the center of the first connecting portion 111 from the four sides of the first connecting portion 111. Therefore, Al atoms in the primary conductive layer 11 try to migrate toward the center of the first connecting portion 111. However, since there is the metal layer 66 that prevents diffusion, the Al atoms cannot migrate and diffuse in an upward direction. Consequently, the Al atoms are accumulated and protrude in the center of the first connecting portion.

At the second connecting portion 222 shown in FIG. 10C, current density is maximized in the stepped portion of the secondary conductive layer 22. Therefore, the secondary conductive layer 22 is deformed in a region close to the four sides of the second connecting portion. However, electrons rarely flow into the center of the second connecting portion all at once.

Thus, large bumps are not easily formed in the center of the second connecting portion, and the failure at the second connecting portion does not easily become apparent compared with that at the first connecting portion. Therefore, even if the contact area of the second connecting portion is brought to be smaller than that of the first connecting portion that has a higher potential than the second connecting portion when a voltage is applied, a liquid ejection head with high reliability at connecting portions can be obtained. Accordingly, a liquid ejection head that achieves both the reduction in the area of a substrate and reliability can be provided.

In the scope of this specification and Claims, "liquid" includes not only ink that provides a desired color to a recording medium but also a transparent process liquid ejected before or after a desired color is provided to a recording medium.

Although an example in which the first and second secondary conductive layers 22 are disposed on the primary conductive layer 11 has been described, the same effects can be produced even if a secondary conductive layer 22 is disposed on a pair of primary conductive layers 11 (first and second) through an insulating layer. In this case, a connecting portion that connects a first primary conductive layer to the secondary conductive layer is defined as a first connecting portion 111. A connecting portion that connects a second primary conductive layer to the secondary conductive layer is defined as a second connecting portion 222. Even if the contact area of the first connecting portion is brought to be smaller than that of the second connecting portion that has a higher potential than the first connecting portion when a voltage is applied to the first and second primary conductive layers, a liquid ejection head with high reliability at connecting portions can be obtained. Accordingly, a liquid ejection head that achieves both the reduction in the area of a substrate and reliability can be provided. Herein, at the first connecting portion, electrons flow from the secondary conductive layer to the primary conductive layer through the metal layer. At the second connecting portion, electrons flow from the primary conductive layer to the secondary conductive layer through the metal layer.

First Embodiment

Liquid Ejection Head Substrate

Figure 1:
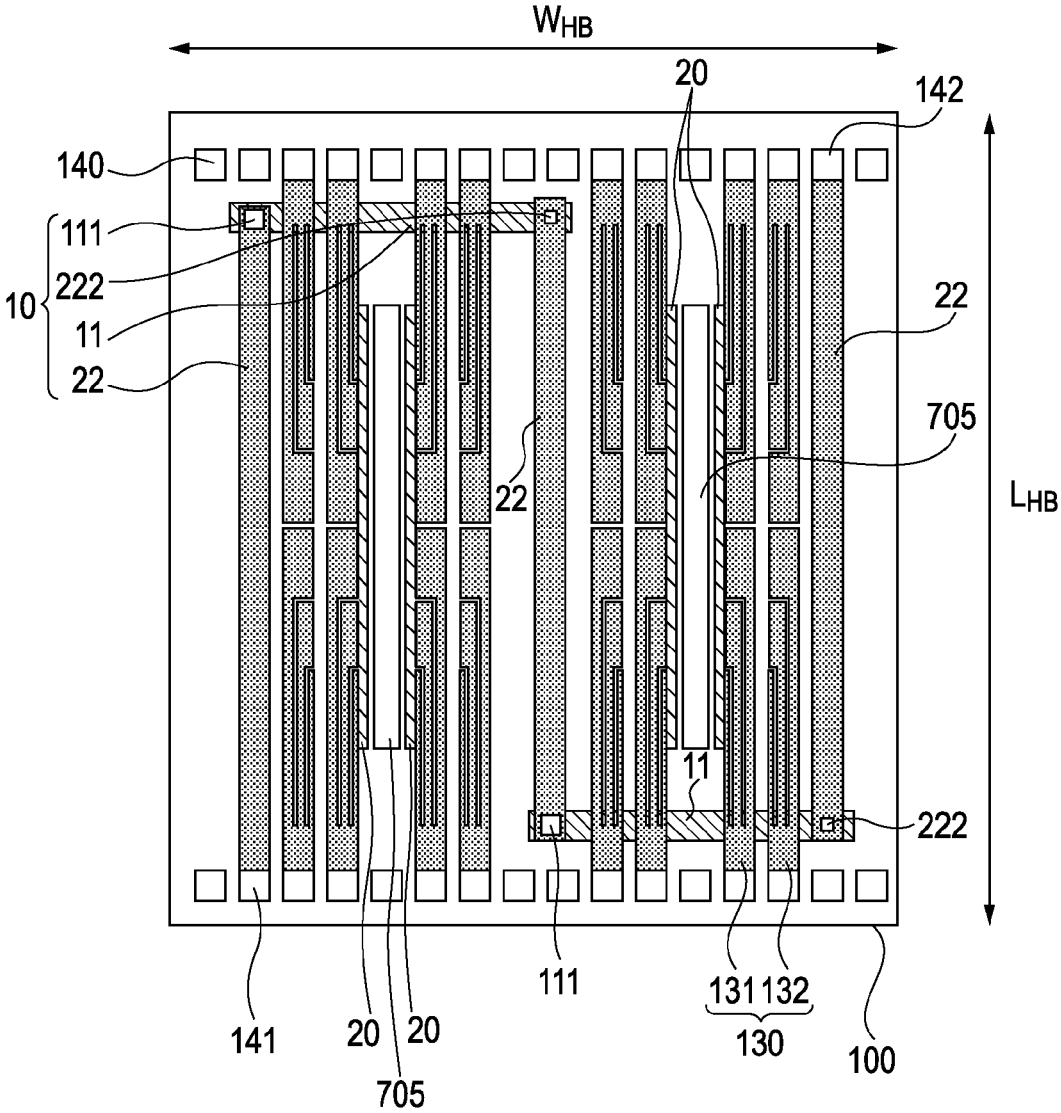
FIG. 1 is a schematic plan view of a head substrate according to an embodiment of the present invention.

FIG. 1 is a plan view schematically showing a head substrate of this embodiment. A head substrate 100 includes a plurality of ejection heaters 20 used as a device configured to generate energy for ejecting liquid, a sub-heater 10 configured to preheat a liquid ejection head substrate, and a pair of tertiary conductive layers (heater wiring lines 130) configured to supply power to the ejection heaters 20. The heater wiring lines 130 are constituted by a ground wiring line 131 and a power source wiring line 132, and the substrate is electrically connected to an external control unit through a pad 140. The head substrate 100 further includes a switching element (not shown in FIG. 1) configured to drive the ejection heaters and a driving circuit (not shown in FIG. 1) configured to drive the switching element. An insulating layer is disposed on the switching element, the driving circuit, and a quaternary conductive layer (logic wiring line) configured to supply power to these drivers. A heat resistive layer and the pair of tertiary conductive layers are disposed on the insulating layer. By connecting the pair of tertiary conductive layers to the heat resistive layer to supply power to the heat resistive layer, the heaters are formed.

In addition, a primary conductive layer 11, an insulating layer, a metal layer, and first and second secondary conductive layers 22 are stacked in sequence on the substrate in that order. The primary conductive layer 11 is in contact with the metal layer, penetrating the insulating layer, and is electrically connected to the secondary conductive layers 22 at a connecting portion 111 and a connecting portion 222 of the insulating layer. The sub-heater includes the first and second secondary conductive layers 22 and the primary conductive layer 11 connected to the secondary conductive layers 22 through the connecting portions 111 and 222.

Herein, the secondary conductive layers and the tertiary conductive layers that are heater wiring lines are layers disposed on the insulating layer in the same manner. Thus, they can be simultaneously formed using a material having the same composition (the same constituent elements) during manufacturing. This can reduce the number of manufacturing steps and manufacturing costs.

The primary conductive layer 11 and the quaternary conductive layer used as a logic wiring line are layers disposed below the insulating layer in the same manner. Thus, they can be simultaneously formed using a material having the same composition (the same constituent elements) during manufacturing. This can reduce the number of manufacturing steps and manufacturing costs.

The primary conductive layer 11, the secondary conductive layers 22, the tertiary conductive layers, and the quaternary conductive layer can be composed of a material containing at least one of Al, Au, Cu, and Si or can be composed of an alloy thereof.

The sub-heater is connected to an external power source through a sub-heater power source pad 141 and a sub-heater ground pad 142. In the head substrate of this embodiment, the potential of the sub-heater ground pad 142 is set to be a reference potential. Because a positive voltage (+24 V) is applied to the sub-heater power source pad 141, electrons flow from the primary conductive layer to the secondary conductive layer at the connecting portion 111 and flow from the secondary conductive layer to the primary conductive layer at the connecting portion 222. In this embodiment, the sub-heater is controlled by providing the voltage application from an external unit or by stopping the voltage application. However, with a switching element disposed on the substrate, the sub-heater may be controlled using a control signal inputted from the external unit.

Description of Connecting Portion of Substrate-Heating Heater

It is the first connecting portion that differentiates Comparative Example shown in FIGS. 8 to 9B from this embodiment. In this specification, a value obtained by dividing electric current that flows through the connecting portion by a contact area of the connecting portion is expressed as "current density at a connecting portion".

In this embodiment, the life of the head substrate depends on the first connecting portion where hillocks are remarkably produced. When a voltage is applied between the sub-heater power source pad 141 and the sub-heater ground pad 142, current density at the first connecting portion is brought to be smaller than that at the second connecting portion. When there are a plurality of first connecting portions and a plurality of second connecting portions, the maximum current density at the first connecting portions is desirably smaller than that at the second connecting portions.

Furthermore, the same effect is produced if the contact area of the first connecting portion is larger than that of the second connecting portion. When there are a plurality of first connecting portions and a plurality of second connecting portions, the minimum contact area of the first connecting portions is desirably larger than that of the second connecting portions. When a voltage is applied between the sub-heater power source pad 141 and the sub-heater ground pad 142, that is, when a voltage is applied to the first and second secondary conductive layers, the first connecting portion has a higher potential than the second connecting portion.

A representative layer structure at the connecting portion of the substrate-heating heater (sub-heater) in this embodiment will be described with reference to FIGS. 2A to 3B. The description of the same parts as those described in Comparative Example shown in FIGS. 8 to 9B is omitted.

Figure 2A:
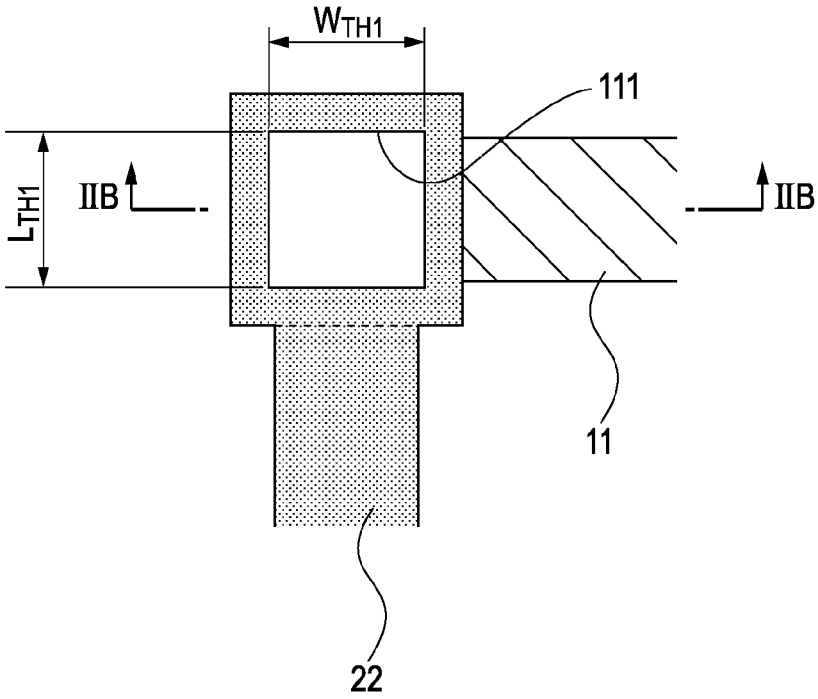
FIGS. 2A and 2B are enlarged views in the vicinity of a connecting portion according to a first embodiment.
Figure 2B:
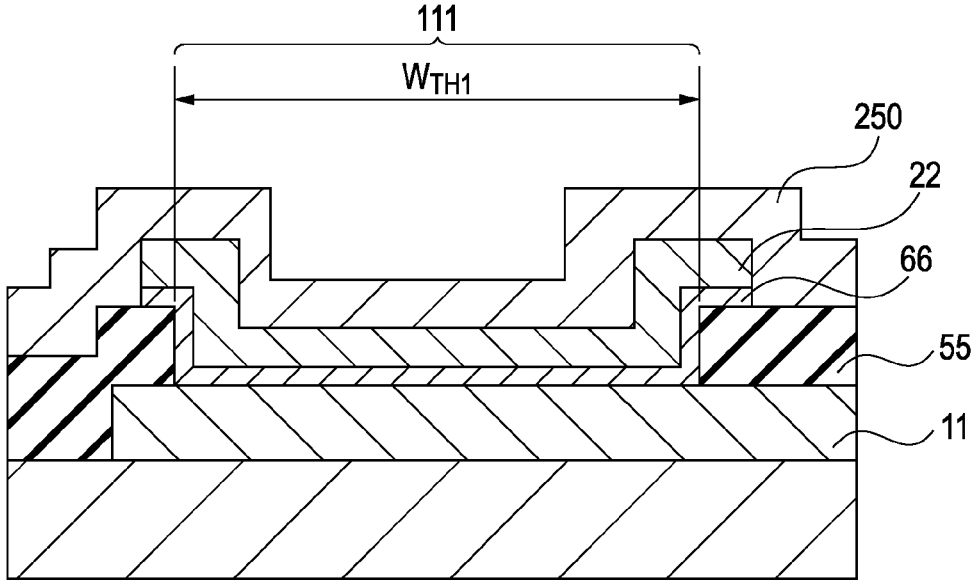

FIG. 2A is a schematic view of the first connecting portion 111 in the sub-heater 10 of FIG. 1. At the first connecting portion, electrons flow from the primary conductive layer to the secondary conductive layer. Herein, the connecting portion 111 is schematically shown as a connecting portion obtained by forming an opening in the insulating layer 55. FIG. 2B is a sectional view taken along line IIB-IIB of FIG. 2A.

Figure 3A:
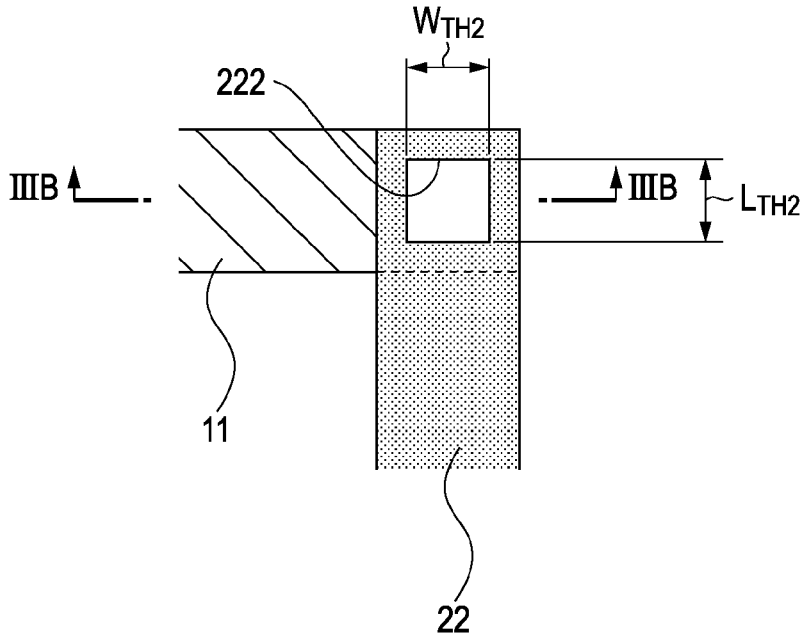
FIGS. 3A and 3B are enlarged views in the vicinity of a connecting portion according to the first embodiment.
Figure 3B:
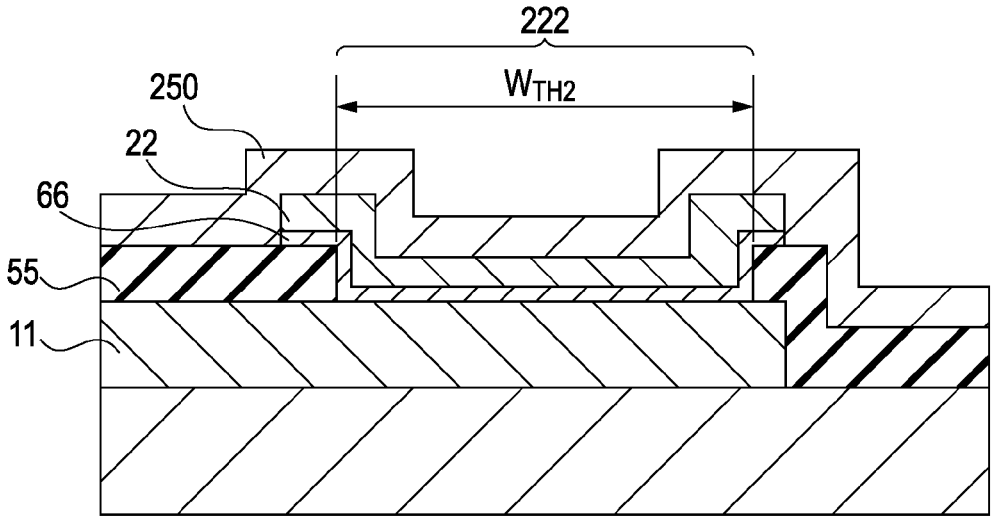

FIG. 3A is a schematic view of the second connecting portion 222 in the sub-heater 10 of FIG. 1. At the second connecting portion, electrons flow from the secondary conductive layer to the primary conductive layer. Herein, the connecting portion 222 is schematically shown as a connecting portion obtained by forming an opening in the insulating layer 55. FIG. 3B is a sectional view taken along line IIIB-IIIB of FIG. 3A.

As shown in FIGS. 2B and 3B, the primary conductive layer 11 is formed on a substrate. The insulating layer 55 having a plurality of connecting portions is formed on the primary conductive layer. The metal layer 66 having a depressed shape is formed on the insulating layer so as to cover each of the connecting portions. The secondary conductive layer 22 is formed on the metal layer, and the protective layer 250 is formed on the secondary conductive layer.

The primary conductive layer and the secondary conductive layer are electrically connected to each other through the metal layer at the connecting portion. Thus, when a voltage is applied between the sub-heater power source pad 141 and the sub-heater ground pad 142, the primary conductive layer and the secondary conductive layer are heated. By preheating the substrate using the primary conductive layer and the secondary conductive layer as a sub-heater, ejection can be performed in a uniform temperature distribution and liquid can be uniformly ejected to a recording medium.

The metal layer can be composed of a material containing a refractory metal element (Ti, V, Cr, Zr, Nb, Mo, Hf, Ta, and W) used as a adhesion layer or a barrier metal or a material containing a platinum group element (Os, Ir, Pt, Ru, Rh, and Pd) or can be composed of an alloy thereof. With such a material, the adhesion between the primary conductive layer and the secondary conductive layer can be achieved while the E. M. of the primary conductive layer can be effectively prevented.

In this embodiment, the metal layer 66 is composed of TaSiN that is also a material of a heater layer used for the ejection heater 20, which generates energy for ejecting liquid. The metal layer 66 and the heater layer are composed of a material having the same composition (the same constituent elements), whereby the number of manufacturing steps and manufacturing costs can be reduced.

The contact area at the connecting portion in this embodiment means an area of an opening of the insulating layer 55. In this embodiment, since the opening is quadrilateral, the contact area is an area of a quadrilateral.

Liquid Ejection Head

Figure 11:
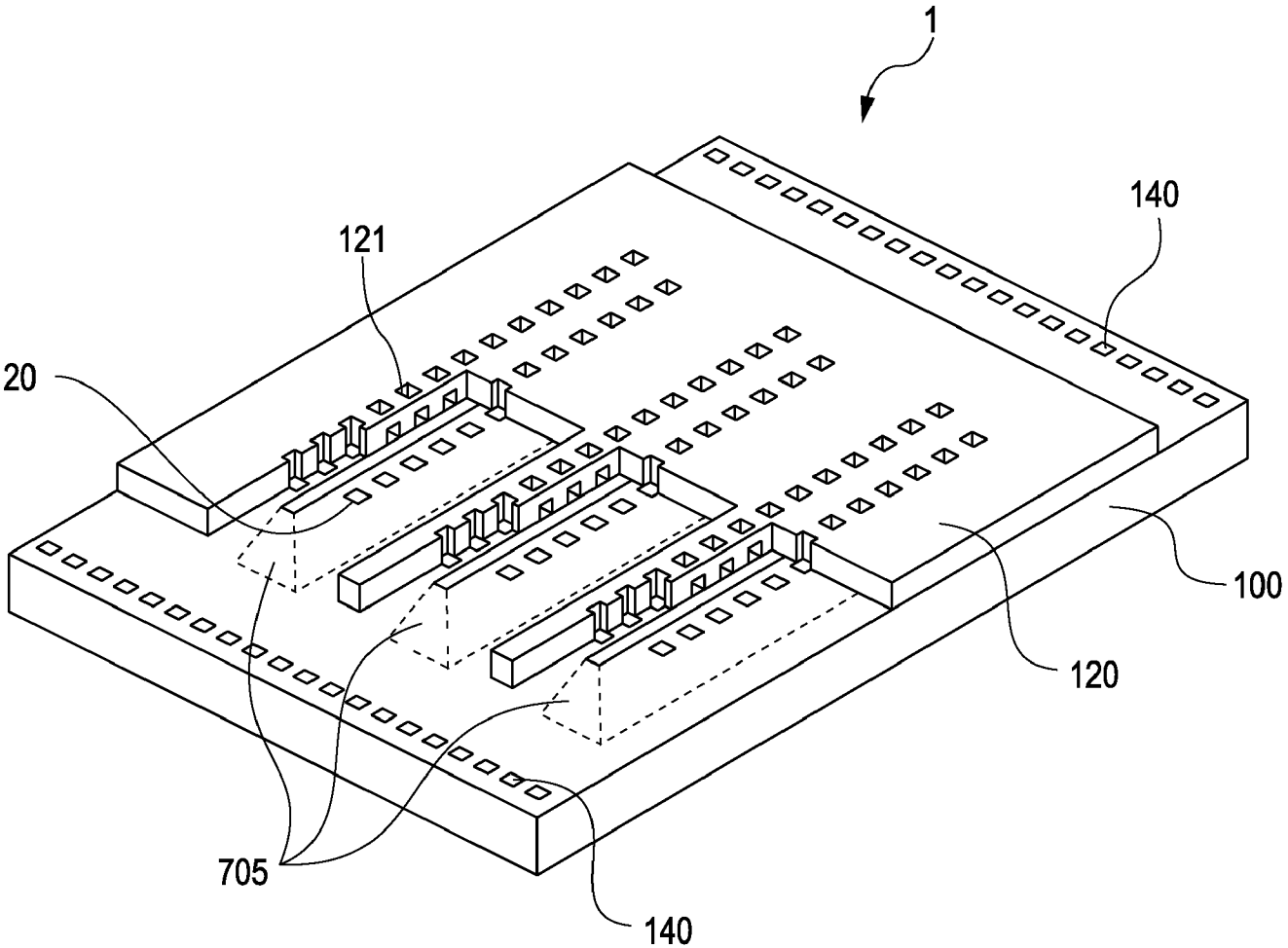
FIG. 11 is a schematic view of a head.

FIG. 11 is a perspective view schematically showing a liquid ejection head of this embodiment. As shown in FIG. 11, the above-described head substrate 100 has at least one supply port 705 configured to supply liquid. The at least one supply port 705 may include a plurality of supply ports 705. In this case, each of the supply ports can supply a different type of liquid. The plurality of heaters 20 configured to generate energy for ejecting liquid are disposed on both sides of the supply port 705 in the longitudinal direction of the supply port. The head substrate includes a channel member 120 having ejection ports 121 configured to eject liquid and walls. The channel member 120 defines channels communicating with the ejection ports 121 by being brought into contact with the head substrate 100 such that the walls are arranged to face inward. The ejection ports 121 are disposed in positions corresponding to those of the heaters 20. By heating the heaters 20, liquid is ejected from the ejection ports 121.

The head substrate is preheated using the primary conductive layer and the secondary conductive layer as a sub-heater to perform ejection in a uniform temperature distribution of the head substrate, whereby, for example, the viscosity of liquid can be controlled to be constant in the entire head substrate. Thus, a constant ejection amount of liquid can be achieved, which can provide a liquid ejection head that has high reliability and does not cause blurs and unevenness on a recording medium.

Liquid Ejection Apparatus

Figure 12:
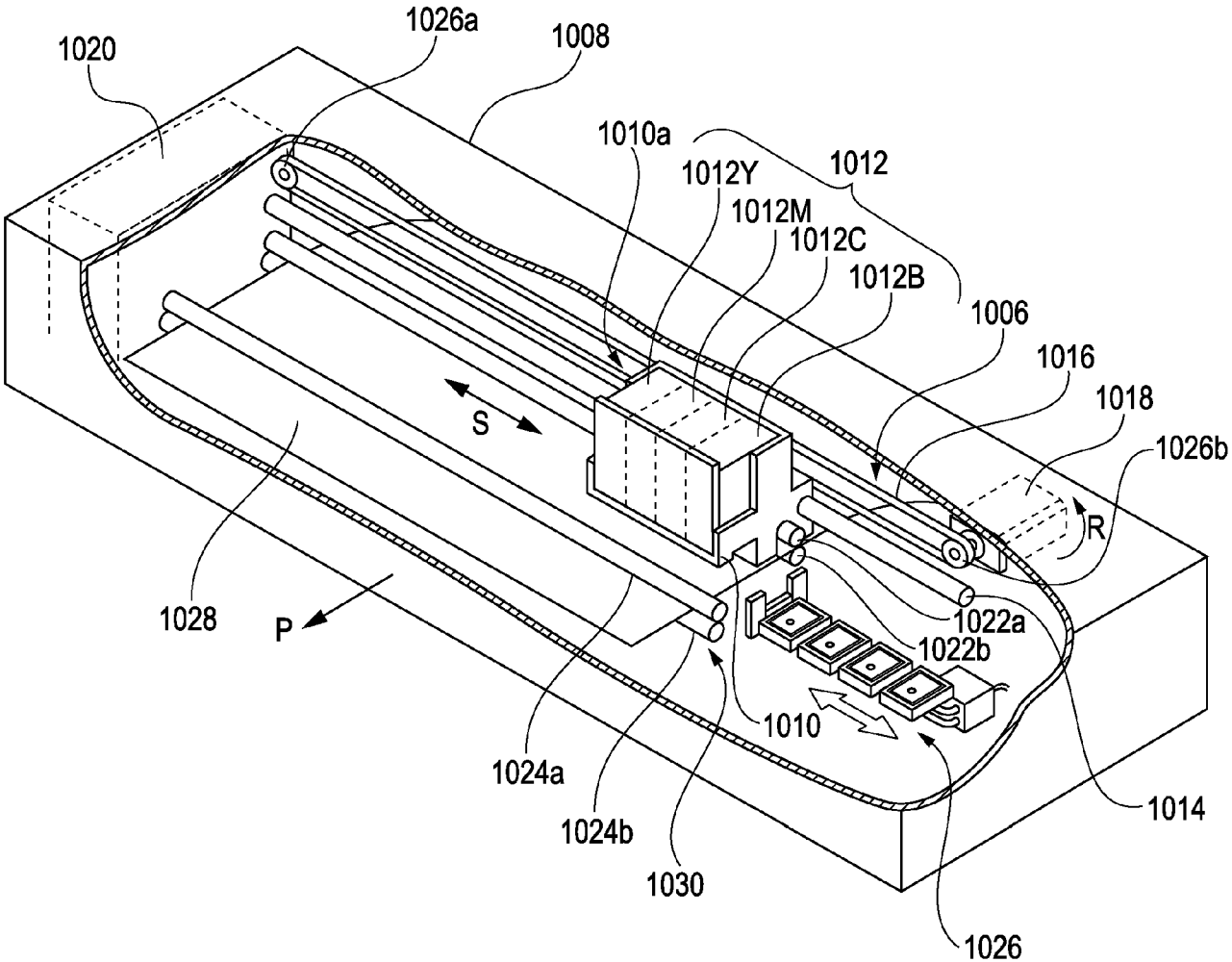
FIG. 12 is a schematic view of a liquid ejection apparatus.

FIG. 12 is a perspective view schematically showing the principal part of a liquid ejection apparatus (ink jet printer). The liquid ejection apparatus includes a casing 1008 and a conveying device 1030 that intermittently conveys a sheet 1028 as a recording medium in a P direction indicated by an arrow. The liquid ejection apparatus further includes a recording member 1010 having a head that reciprocates in an S direction perpendicular to the P direction in which the sheet 1028 is conveyed and a movement driving member 1006 as a driving unit for allowing the recording member 1010 to reciprocate.

The conveying device 1030 includes a pair of roller units 1022*a* and 1022*b* disposed in parallel so as to face each other, a pair of roller units 1024*a* and 1024*b* disposed in parallel so as to face each other, and a driving member 1020 configured to drive these roller units. When the driving member 1020 is operated, the sheet 1028 is pinched between the roller units 1022*a* and 1022*b* and between the roller units 1024*a* and 1024*b*, and conveyed intermittently in the P direction.

The movement driving member 1006 includes a belt 1016 and a motor 1018. The belt 1016 is hung on pulleys 1026*a* and 1026*b* disposed at a certain interval between their rotation shafts so as to face each other, and is disposed so as to be in parallel with the roller units 1022*a* and 1022*b*. The motor 1018 drives the belt 1016 connected to a carriage member 1010*a* of the recording member 1010 in forward and reverse directions.

When the motor 1018 is operated and the belt 1016 is rotated in an R direction indicated by an arrow, the carriage member 1010*a* moves in the S direction by a certain distance. When the belt 1016 is rotated in a direction opposite to the R direction, the carriage member 1010*a* moves in a direction opposite to the S direction by a certain distance. In addition, a recovery unit 1026 configured to perform ejection recovery treatment of the recording member 1010 is disposed at a home position of the carriage member 1010*a* so as to face the surface from which the recording member 1010 ejects liquid.

The recording member 1010 includes a cartridge 1012 that is detachable to the carriage member 1010*a*. The cartridge is constituted by, for example, a yellow cartridge 1012Y, a magenta cartridge 1012M, a cyan cartridge 1012C, and a black cartridge 1012B.

First Embodiment and Comparative Example

In this embodiment, as shown in FIGS. 2B and 3B, the primary conductive layer 11 composed of aluminum (hereinafter AL1), the insulating layer 55 having a quadrilateral opening and composed of P—SiO, the metal layer 66 composed of TaSiN, the secondary conductive layer 22 composed of aluminum (hereinafter AL2), and the protective layer 250 composed of SiN were formed in sequence on the substrate in that order.

FIG. 2A shows the first connecting portion 111 where electrons flow from AL1 to AL2. The opening opened in the insulating layer 55 has a square shape with a size of $W_{TH1}$=60 μm and $L_{TH1}$=60 μm. On the other hand, FIG. 3A shows the second connecting portion 222 where electrons flow from AL2 to AL1. The opening opened in the insulating layer 55 has a square shape with a size of $W_{TH2}$=30 μm and $L_{TH2}$=30 μm. The size of the substrate in a direction perpendicular to the supply port is 4 mm ($W_{HB}$) and the size in a longitudinal direction of the supply port is 9 mm ($L_{HB}$).

In this structure, the current density at the first connecting portion 111 is ¼ times that at the second connecting portion 222. The contact area at the first connecting portion 111 is four times that at the second connecting portion 222.

In Comparative Example 1, as shown in FIG. 8, there was prepared a substrate 1 in which the first connecting portion and the second connecting portion each has an opening in the insulating layer whose size is $W_{TH}$=30 μm and $L_{TH}$=30 μm regardless of the direction of electron flow.

In Comparative Example 2, as shown in FIG. 8, there was prepared a substrate 2 in which the first connecting portion and the second connecting portion each has an opening in the insulating layer whose size is $W_{TH}$=60 μm and $L_{TH}$=60 μm regardless of the direction of electron flow.

A sample was placed in a 70° C. environment that is an accelerating test condition of E. M. durability investigation. A DC 30 V was continuously applied to the sub-heater power source pad 141 using the voltage of the sub-heater ground pad 142 as a reference voltage. The input energy to the sub-heater was about 4 W and the substrate temperature was maintained at about 140° C.

In the substrate according to the first embodiment of the present invention, the current density at the first connecting portion 111 was about $0.4\times10^4$ A/cm$^2$, and the current density at the second connecting portion 222 was about $1.5\times10^4$ A/cm$^2$.

In Comparative Example 1, the current densities at the first connecting portion and the second connecting portion were both about $1.5\times10^4$ A/cm$^2$.

In Comparative Example 2, the current densities at the first connecting portion and the second connecting portion were both about $0.4\times10^4$ A/cm$^2$.

As a result of the E. M. durability investigation, the endurance time in this embodiment was 2950 hours and the substrate size was 35.4 mm$^2$. The endurance time in Comparative Example 1 was 280 hours and the substrate size was 35.2 mm$^2$. The endurance time in Comparative Example 2 was 2960 hours and the substrate size was 35.6 mm$^2$. All of the substrates had the same failure mode. That is to say, hillocks were produced in the center of AL1 of the first connecting portion and the protective layer that is an upper layer was broken as shown in FIG. 10B.

The E. M. failure time in Comparative Example 2 was about 10 times longer than that in Comparative Example 1. However, since both areas of the first connecting portion and the second connecting portion were increased in Comparative Example 2, the substrate size was increased compared with Comparative Example 1.

In contrast, in this embodiment, the E. M. failure time was 10 times longer than that in Comparative Example 1 and an increase in the substrate size was only a half of that in Comparative Example 2.

In other words, in this embodiment, the allowable limit of AL hillocks that cause the breakage of the protective layer is extended by increasing only an area of the first connecting portion that affects E. M. durability. Furthermore, the substrate size can be prevented from being increased. By suppressing the current density at the first connecting portion, the E. M. durability of the wiring sub-heater can be improved without increasing the substrate size.

Second Embodiment

A second embodiment will be described with reference to FIGS. 4A to 5B. The description of the same structure and materials as those in the first embodiment is omitted.

Figure 4A:
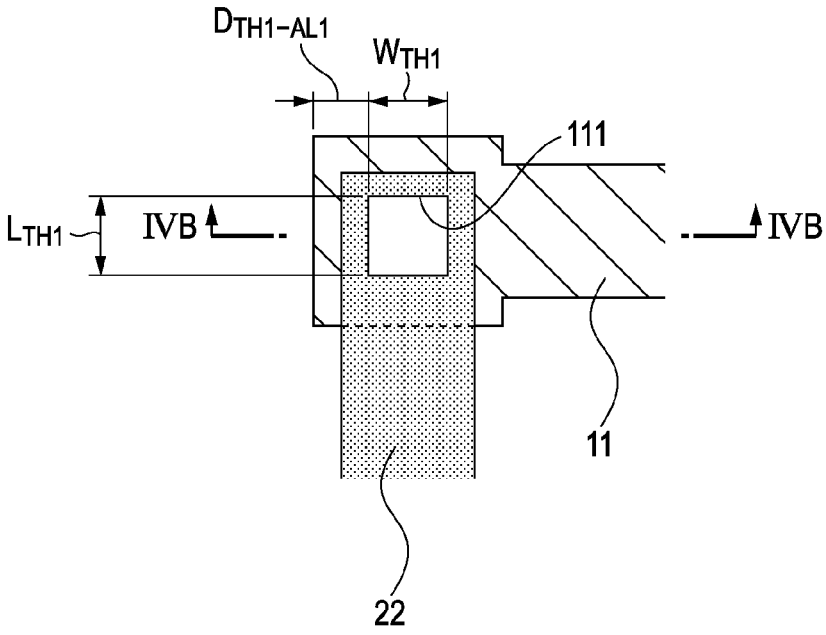
FIGS. 4A and 4B are enlarged views in the vicinity of a connecting portion according to a second embodiment.
Figure 4B:
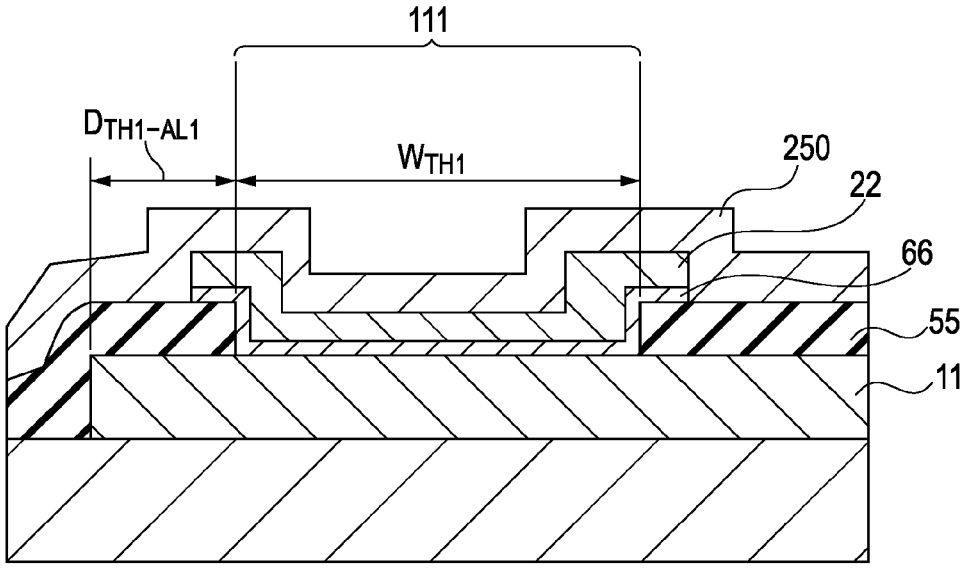
Figure 5A:
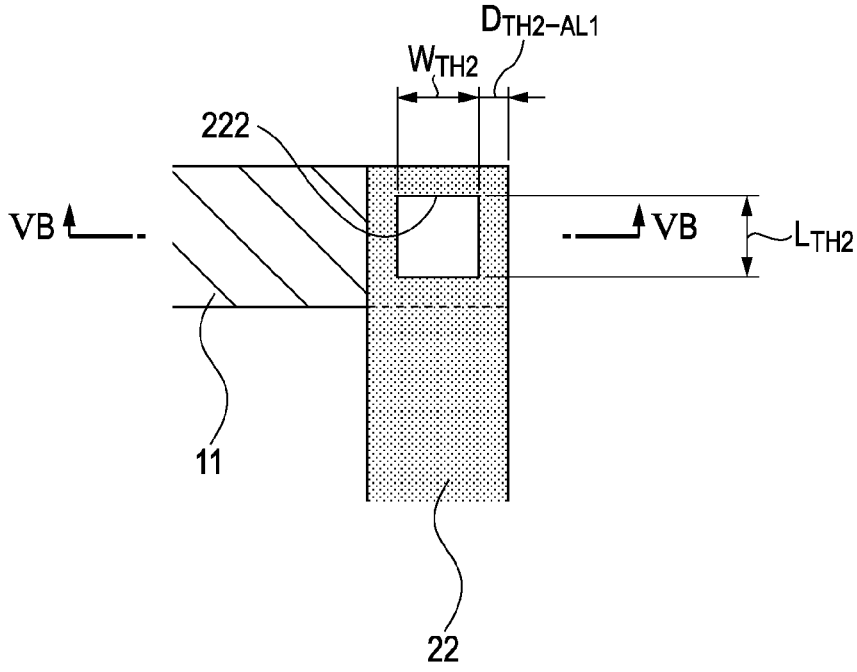
FIGS. 5A and 5B are enlarged views in the vicinity of a connecting portion according to the second embodiment.
Figure 5B:
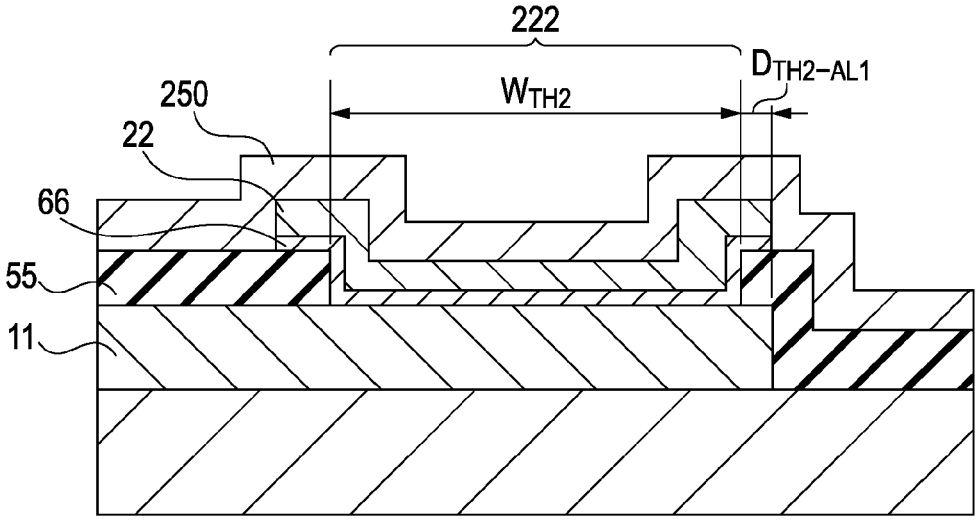

FIG. 4A is a schematic view of the first connecting portion 111 in the sub-heater 10. At the first connecting portion, electrons flow from the primary conductive layer (AL1) to the secondary conductive layer (AL2). FIG. 4B is a sectional view taken along line IVB-IVB of FIG. 4A. FIG. 5A is a schematic view of the second connecting portion 222 in the sub-heater 10. At the second connecting portion, electrons flow from the secondary conductive layer to the primary conductive layer. FIG. 5B is a sectional view taken along line VB-VB of FIG. 5A. The layer structure is the same as in the first embodiment.

At both the connecting portions 111 and 222, the opening opened in the insulating layer 55 has a square shape with a size of $W_{TH1}$=$W_{TH2}$=30 μm and $L_{TH1}$=$L_{TH2}$=30 μm.

In a plan view seen from the upper side of a substrate, the shortest distance ($D_{TH1\text{-}AL1}$) between the edge of the first connecting portion 111 and the edge of the primary conductive layer is 20 μm whereas the shortest distance ($D_{TH2\text{-}AL1}$) between the edge of the second connecting portion 222 and the edge of the primary conductive layer is 10 μm. In other words, the deviation of the current density at the first connecting portion 111 where electrons flow from the primary conductive layer to the secondary conductive layer is smaller than that at the second connecting portion 222 where electrons flow from the secondary conductive layer to the primary conductive layer.

In Comparative Example 3, as shown in FIG. 8, there was prepared a substrate 3 in which the shortest distance ($D_{TH\text{-}AL1}$) between the edge of the first connecting portion and the edge of the primary conductive layer is 10 μm regardless of the direction of electron flow, to perform E. M. durability investigation. The accelerating test condition of E. M. durability investigation is the same as that described in the first embodiment. In both the substrates of this embodiment and Comparative Example 3, a failure mode was seen at the first connecting portion where electrons flow from AL1 to AL2. That is to say, hillocks were produced in the center of AL1 at the first connecting portion and the protective layer that is an upper layer was broken as shown in FIG. 10B. The E. M. failure time of the substrate in this embodiment was about 1.5 times longer than that in Comparative Example 3.

Thus, the distance between the edge of the first connecting portion and the edge of the primary conductive layer is brought to be longer than the distance between the edge of the second connecting portion and the edge of the primary conductive layer, which can suppress the deviation of the current density of the primary conductive layer at the first connecting portion 111 that has poor E. M. durability. This can further improve the E. M. durability of the wiring sub-heater without increasing the substrate size.

Third Embodiment

A third embodiment will be described with reference to FIGS. 6A to 7B. The description of the same structure and materials as those in the first and second embodiments is omitted.

Figure 6A:
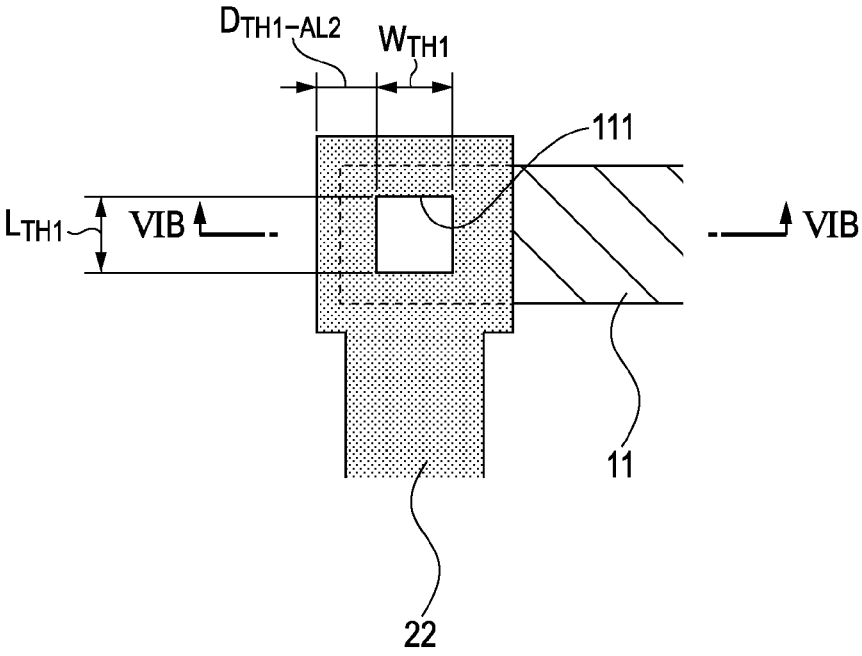
FIGS. 6A and 6B are enlarged views in the vicinity of a connecting portion according to a third embodiment.
Figure 6B:
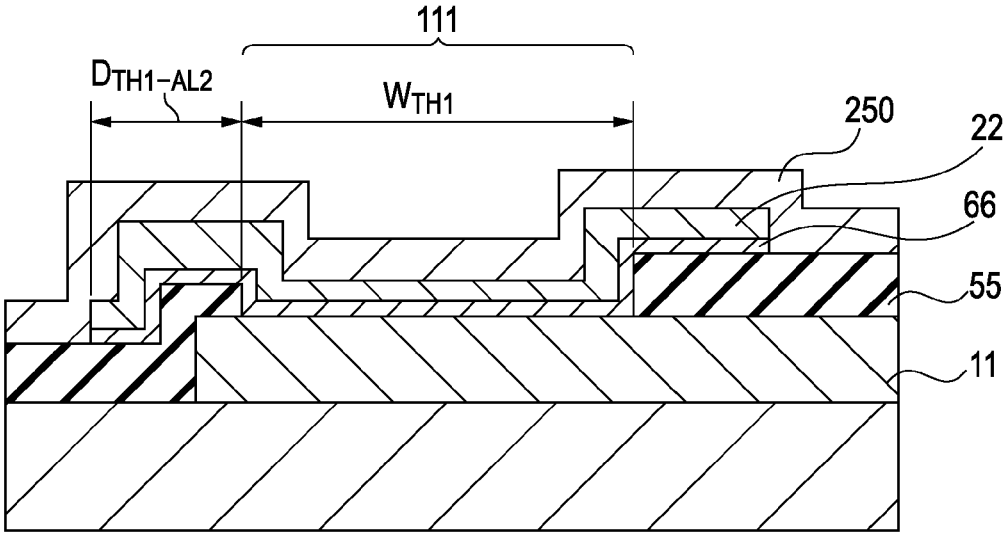
Figure 7A:
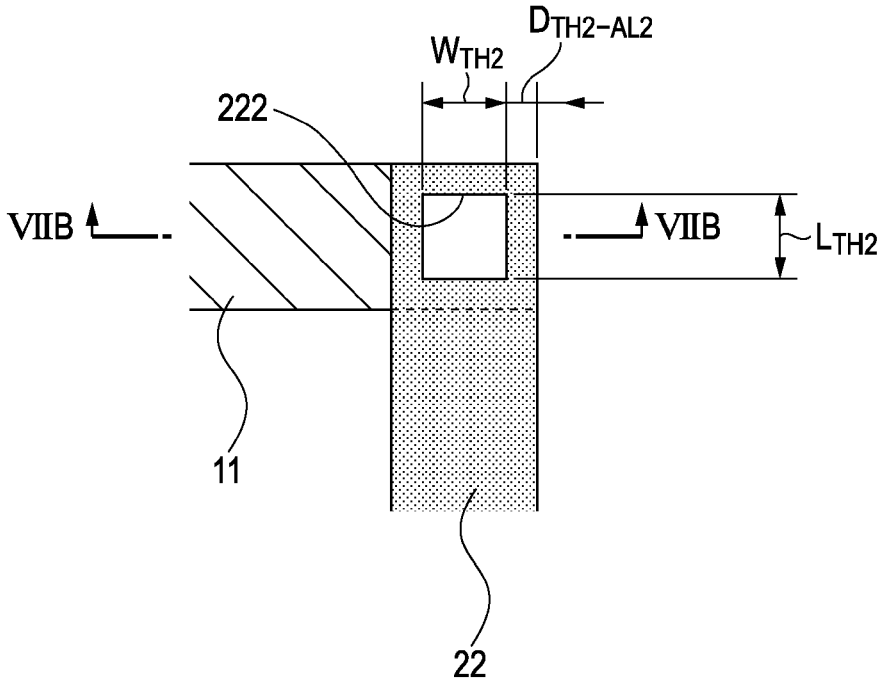
FIGS. 7A and 7B are enlarged views in the vicinity of a connecting portion according to the third embodiment.
Figure 7B:
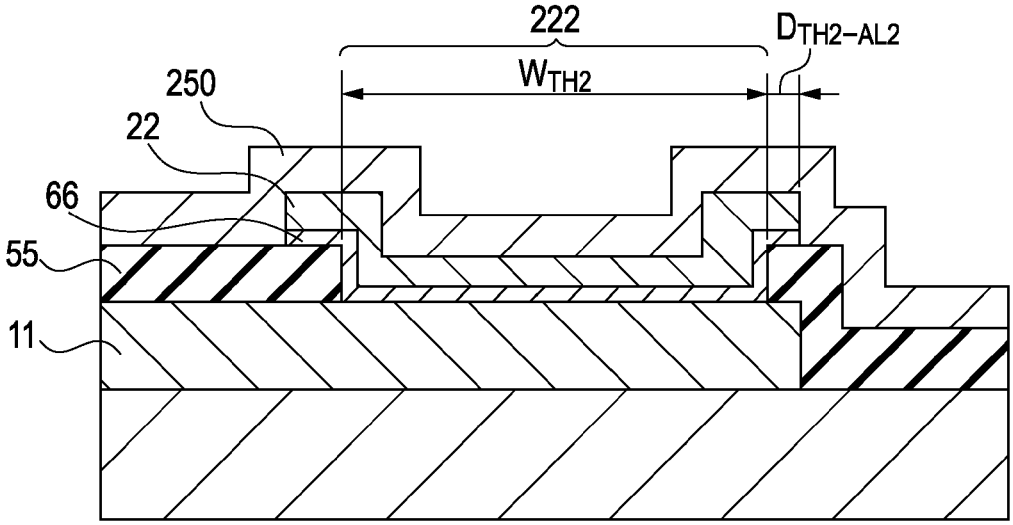

FIG. 6A is a schematic view of the first connecting portion 111 in the sub-heater 10. At the first connecting portion, electrons flow from the primary conductive layer (AL1) to the secondary conductive layer (AL2). Herein, the connecting portion 111 is schematically shown as a connecting portion obtained by forming an opening in the insulating layer 55. FIG. 6B is a sectional view taken along line VIB-VIB of FIG. 6A. FIG. 7A is a schematic view of the second connecting portion 222 in the sub-heater 10. At the second connecting portion, electrons flow from the secondary conductive layer to the primary conductive layer. Herein, the connecting portion 222 is schematically shown as a connecting portion obtained by forming an opening in the insulating layer 55. FIG. 7B is a sectional view taken along line VIIB-VIIB of FIG. 7A. The layer structure is the same as in the first embodiment.

At both the connecting portions 111 and 222, the opening opened in the insulating layer 55 has a square shape with a size of $W_{TH1}=W_{TH2}=30$ μm and $L_{TH1}=L_{TH2}=30$ μm.

In a plan view seen from the upper side of a substrate, the shortest distance ($D_{TH1\text{-}AL2}$) between the edge of the first connecting portion 111 and the edge of the secondary conductive layer is 20 μm whereas the shortest distance ($D_{TH2\text{-}AL2}$) between the edge of the second connecting portion 222 and the edge of the secondary conductive layer is 10 μm. In other words, the deviation of the current density in the secondary conductive layer at the edge of the first connecting portion 111 where electrons flow from the primary conductive layer to the secondary conductive layer is smaller than that in the secondary conductive layer at the edge of the second connecting portion 222 where electrons flow from the secondary conductive layer to the primary conductive layer.

In Comparative Example 4, as shown in FIG. 8, there was prepared a substrate 4 in which the shortest distance ($D_{TH\text{-}AL2}$) between the edge of the second connecting portion and the edge of the secondary conductive layer is 10 μm regardless of the direction of electron flow, to perform E. M. durability investigation. The accelerating test condition of E. M. durability investigation is the same as that described in the first embodiment. In both the substrates of this embodiment and Comparative Example 4, a failure mode was seen at the first connecting portion 111 where electrons flow from the primary conductive layer to the secondary conductive layer. That is to say, hillocks were produced in the center of the primary conductive layer at the first connecting portion and the protective layer that is an upper layer was broken as shown in FIG. 10B. The E. M. failure time of the substrate in this embodiment was about 1.3 times longer than that in Comparative Example 4.

Thus, the distance between the edge of the first connecting portion and the edge of the secondary conductive layer is brought to be longer than the distance between the edge of the second connecting portion and the edge of the secondary conductive layer, which can suppress the deviation of the current density of the secondary conductive layer at the first connecting portion 111 that has poor E. M. durability. This can further improve the E. M. durability of the wiring sub-heater without increasing the substrate size.

The present invention may be achieved by combining the above-described embodiments.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321646 filed Dec. 17, 2008, which is hereby incorporated by reference herein in its entirety.

What is claimed is:

1. A liquid ejection head substrate comprising:

a substrate on which a primary conductive layer, an insulating layer, and secondary conductive layers, which include a first secondary conductive layer and a second secondary conductive layer, are stacked in sequence in that order;

a first connecting portion where the primary conductive layer contacts the first secondary conductive layer, the first connecting portion penetrating the insulating layer; and a second connecting portion where the primary conductive layer contacts the second secondary conductive layer, the second connecting portion penetrating the insulating layer, wherein a contact area where the primary conductive layer contacts the second secondary conductive layer in the second connecting portion is smaller than a contact area where the primary conductive layer contacts the first secondary conductive layer in the first connecting portion, and wherein when a voltage is applied, the first secondary conductive layer has a higher potential than the second secondary conductive layer.

2. The liquid ejection head substrate according to claim 1, wherein the primary conductive layer and the secondary conductive layers generate heat for heating the liquid ejection head substrate when the voltage is applied between the secondary conductive layers.

3. The liquid ejection head substrate according to claim 1, wherein a value obtained by dividing electric current that flows when the voltage is applied between the secondary conductive layers by the contact area where the primary conductive layer contacts the first secondary conductive layer in the first connecting portion is smaller than a value obtained by dividing the electric current by the contact area where the primary conductive layer contacts the second secondary conductive layer in the second connecting portion.

4. The liquid ejection head substrate according to claim 1, wherein, when the voltage is applied between the secondary conductive layers, electrons flow from the primary conductive layer to the first secondary conductive layer and from the second secondary conductive layer to the primary conductive layer.

5. The liquid ejection head substrate according to claim 1, further comprising:

metal layers disposed in regions where the secondary conductive layers contact the primary conductive layer, the metal layers containing a refractory metal element or a platinum group element and preventing diffusion of materials contained in the primary conductive layer and the secondary conductive layers.

6. The liquid ejection head substrate according to claim 5, further comprising:

a heat resistive layer disposed on the insulating layer; and a pair of tertiary conductive layers connected to the heat resistive layer, wherein a portion of the heat resistive layer situated between the pair of tertiary conductive layers is configured to generate energy for ejecting liquid.

7. The liquid ejection head substrate according to claim 6, wherein the metal layers and the heat resistive layer are composed of the same constituent element.

8. The liquid ejection head substrate according to claim 6, wherein the secondary conductive layers and the tertiary conductive layers are composed of the same constituent element.

9. The liquid ejection head substrate according to claim 1, wherein the primary conductive layer and the secondary conductive layers are each composed of a material containing at least one of Al, Au, Cu, and Si.

10. A liquid ejection head comprising:

the liquid ejection head substrate according to claim 1; and a channel member that has a wall and defines a channel communicating with an ejection port by being brought into contact with the liquid ejection head substrate such that the wall is arranged to face inward, the ejection port being configured to eject liquid.

11. The liquid ejection head substrate according to claim 1, wherein the shortest distance between an edge of the first connecting portion and an edge of the primary conductive layer is larger than that between an edge of the second connecting portion and an edge of the primary conductive layer.

12. The liquid ejection head substrate according to claim 1, wherein the shortest distance between an edge of the first connecting portion and the first secondary conductive layer is larger than that between an edge of the second connecting portion and an edge of the second secondary conductive layer.

13. A liquid ejection head substrate comprising:

a substrate on which first and second primary conductive layers, an insulating layer, and a secondary conductive layer are stacked in sequence in that order;

a first connecting portion where the first primary conductive layer is electrically connected to the secondary conductive layer, the first connecting portion penetrating the insulating layer; and a second connecting portion where the second primary conductive layer is electrically connected to the secondary conductive layer, the second connecting portion penetrating the insulating layer, wherein a contact area where the second primary conductive layer contacts the secondary conductive layer in the second connecting portion is smaller than a contact area where the first primary conductive layer contacts the secondary conductive layer in the first connecting portion, and wherein when a voltage is applied between the primary conductive layers, the second primary conductive layer has a higher potential than the first primary conductive layer.

* * * * *